US008986034B2

(12) United States Patent
Siebens

(10) Patent No.: US 8,986,034 B2
(45) Date of Patent: Mar. 24, 2015

(54) RESTRAINT AND LOCK FOR ELECTRICAL CONNECTOR

(71) Applicant: Thomas & Betts International, Inc., Wilmington, DE (US)

(72) Inventor: Larry N. Siebens, Ashbury, NJ (US)

(73) Assignee: Thomas & Betts International, Inc., Wilmington, DE (US)

( * ) Notice: Subject to any disclaimer, the term of this patent is extended or adjusted under 35 U.S.C. 154(b) by 89 days.

(21) Appl. No.: 13/903,049

(22) Filed: May 28, 2013

(65) Prior Publication Data

US 2014/0017923 A1 Jan. 16, 2014

Related U.S. Application Data

(60) Provisional application No. 61/670,828, filed on Jul. 12, 2012.

(51) Int. Cl.

| | |
|---|---|
| ***H01R 4/50*** | (2006.01) |
| ***H01R 13/64*** | (2006.01) |
| ***H01R 43/26*** | (2006.01) |
| ***H01R 4/70*** | (2006.01) |
| ***H01R 31/02*** | (2006.01) |

(52) U.S. Cl.

CPC ..... *H01R 13/64* (2013.01); *H01R 43/26* (2013.01); *H01R 4/70* (2013.01); *H01R 31/02* (2013.01)

USPC ..... 439/345; 439/187

(58) Field of Classification Search

USPC ..... 439/345–347, 181, 186–187, 352, 353, 439/357, 921

See application file for complete search history.

(56) References Cited

U.S. PATENT DOCUMENTS

| | | | |
|---|---|---|---|
| 3,689,866 | A | 9/1972 | Kelly |
| 5,277,605 | A | 1/1994 | Roscizewski |
| 5,433,622 | A | 7/1995 | Galambos |
| 5,445,533 | A | 8/1995 | Roscizewski et al. |
| 5,525,069 | A | 6/1996 | Roscizewski et al. |
| 5,685,730 | A | 11/1997 | Cameron et al. |

(Continued)

FOREIGN PATENT DOCUMENTS

| | | |
|---|---|---|
| CA | 2286788 C | 10/1999 |
| CA | 2752903 | 4/2012 |

(Continued)

OTHER PUBLICATIONS

Extended European search report dated Jan. 20, 2015 for corresponding European Application No. 13176192.

*Primary Examiner* — Xuong Chung Trans
(74) *Attorney, Agent, or Firm* — Snyder, Clark, Lesch & Chung, LLP

(57) ABSTRACT

A connector includes a first member having a first bore, a second member having a second bore configured to align with the first bore, and a fastener for securing the first member to the second member through the first and second bores. The connector includes a tubular extension affixed to the first member and configured to encircle at least a portion of the first member and the second member. The tubular extension includes an access hole to permit insertion of the fastener through the first and second bores and an exit hole to permit extension of the fastener through the first bore or the second bore. The connector further includes a receptacle configured to slide over the tubular extension to form a weather-resistant barrier for the connector. The tubular extension is configured to support the receptacle.

20 Claims, 7 Drawing Sheets

(56) References Cited

U.S. PATENT DOCUMENTS

| | | | | |
|---|---|---|---|---|
| 6,152,770 | A | 11/2000 | Wang | |
| 6,227,908 | B1 | 5/2001 | Aumeier et al. | |
| 6,261,131 | B1 | 7/2001 | Kuroda et al. | |
| 6,309,231 | B1 | 10/2001 | Gordon et al. | |
| 6,332,785 | B1 | 12/2001 | Muench, Jr. et al. | |
| 6,485,326 | B1 | 11/2002 | Trainor et al. | |
| 6,729,903 | B1 | 5/2004 | Clark | |
| 7,491,075 | B2 | 2/2009 | Hughes et al. | |
| 7,530,843 | B1 | 5/2009 | Tesfay et al. | |
| 7,695,333 | B2 | 4/2010 | Strickland, Jr. | |
| 7,726,998 | B2 * | 6/2010 | Siebens | 439/299 |
| 7,870,668 | B2 | 1/2011 | Hughes et al. | |
| 7,892,047 | B2 | 2/2011 | Strickland, Jr. | |
| 8,070,509 | B2 | 12/2011 | Luzzi | |
| 8,172,624 | B2 | 5/2012 | Tiberio, Jr. | |
| 8,616,908 | B2 * | 12/2013 | Siebens | 439/301 |
| 8,882,548 | B2 * | 11/2014 | Siebens | 439/864 |
| 2005/0095925 | A1 | 5/2005 | Luzzi | |
| 2008/0230359 | A1 | 9/2008 | Leccia et al. | |

FOREIGN PATENT DOCUMENTS

| | | |
|---|---|---|
| EP | 0767523 | 4/1997 |
| WO | WO 2011/061074 | 5/2011 |

* cited by examiner

RESTRAINT AND LOCK FOR ELECTRICAL CONNECTOR

CROSS-REFERENCE TO RELATED APPLICATION

This application claims priority under 35 U.S.C. §119, based on U.S. Provisional Patent Application No. 61/670,828 filed Jul. 12, 2012, the disclosure of which is hereby incorporated by reference herein

BACKGROUND OF THE INVENTION

The present invention relates to electrical cable connectors, such as connectors for joining two or more electrical cables, loadbreak connectors, and deadbreak connectors. More particularly, aspects described herein relate to an electrical cable connector that reduces misalignment and/or slippage of connected components.

DETAILED DESCRIPTION OF THE PREFERRED EMBODIMENTS

The following detailed description refers to the accompanying drawings. The same reference numbers in different drawings may identify the same or similar elements.

Figure 1:
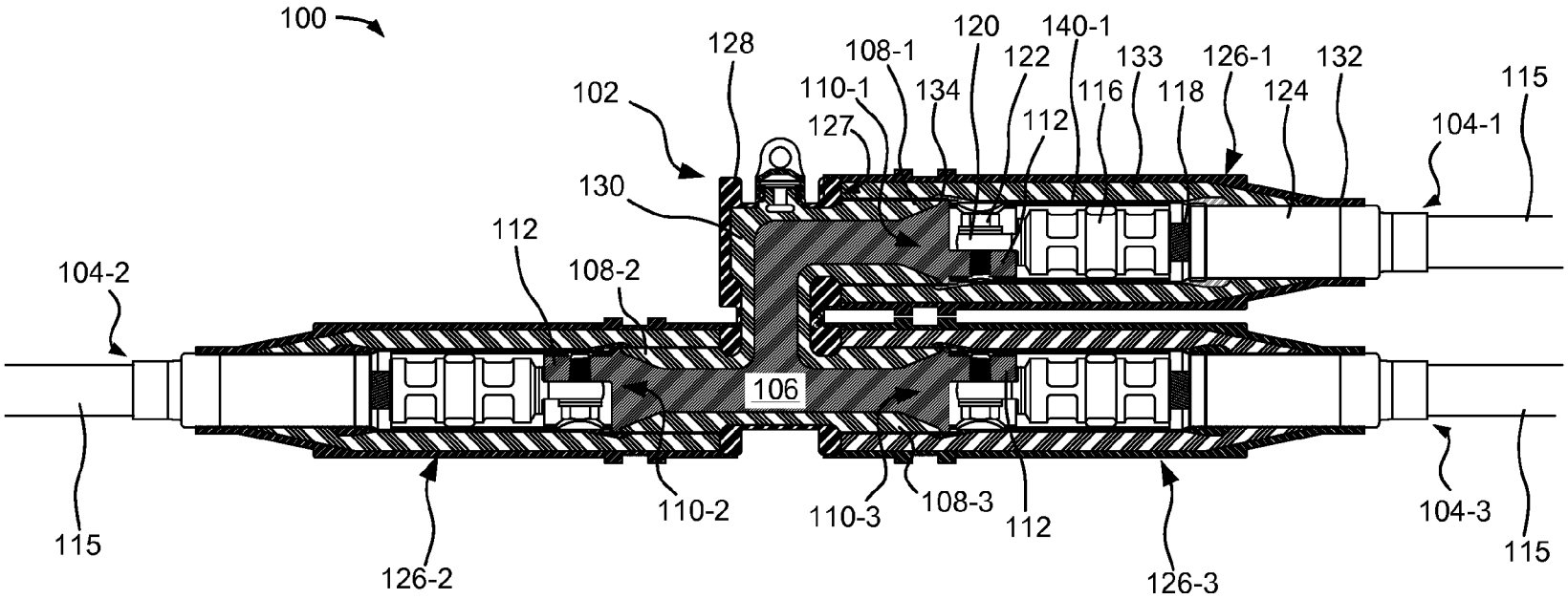
FIG. 1 is a schematic cross-sectional diagram illustrating a power cable splicing assembly consistent with implementations described herein.

FIG. 1 is a schematic cross-sectional diagram illustrating an exemplary power cable splicing assembly 100 consistent with implementations described herein. As shown in FIG. 1, power cable splicing connector 100 may include a three-way (e.g., a "Y") yoke 102 for enabling connection of power cables assemblies 104-1, 104-2, and 104-3 (collectively "power cable assemblies 104," and generically "power cable assembly 104"). For example, power cable assembly 104-1 may include a supply cable and power cable assemblies 104-2 and 104-3 may include load cables. Although described for use with yoke 102, other types of power cable connectors may be configured in accordance with implementations described herein, such as four-way yoke connectors, two-way connectors, etc.

In one implementation, yoke 102 of power cable splicing connector 100 may include a central conductor 106 (also referred to as bus bar 106) and number of taps 108-1 to 108-3 (collectively "taps 108," and generically "tap 108"). Central conductor 106 may be formed of a suitably conductive material, such as copper, aluminum, or other conductive alloy.

Further, as shown in FIG. 1, central conductor 106 may include bus extensions 110-1 to 110-3 (collectively "bus extensions 110," and generically "bus extension 110") that project from respective taps 108 in yoke 102. As described in additional detail below, central conductor 106 may connect each of power cable assemblies 104 to each other power cable assembly 104, such that power applied to one cable is transferred to each other cable.

Bus extensions 110 may be configured to receive connector portions of power cables 104 in the manner consistent with embodiments described herein. For example, each bus extension 110 may include a spade portion 112 (also referred to as "yoke spade portion 112") having a threaded bore 114 (shown in FIG. 2) extending therethrough. Each power cable assembly 104 may be prepared by connecting a power cable 115 to a crimp connector 116. Crimp connector 116 may include a substantially cylindrical assembly configured to receive a cable conductor 118 of power cable 115 therein. During preparing of power cable assembly 104, a portion of crimp connector 116 may be physically deformed (e.g., crimped) to fasten crimp connector 116 to cable conductor 118.

Crimp connector 116 may include a forward spade portion 120 (shown in FIG. 3) (also referred to as "crimp connector spade portion 120") configured to be securely fastened to a spade portion 112 of bus extension 110 of central conductor 106. For example, forward spade portions 120 of each crimp connector 116 may include an opening 121 therein (shown in FIG. 3) configured to align with threaded bore 114 in yoke spade portion 112. A threaded fastener 122 may be inserted through forward spade portion 120 and into threaded bore 114 of yoke spade portion 112 to secure crimp connector 116 to central conductor 106.

As shown in FIG. 1, each of the prepared power cable assemblies 104 may further include an adapter 124 disposed rearwardly relative to crimp connector 116. Adapter 124 may be affixed to power cable 115 and may provide a frictional engagement with a rearward portion of a respective cable receptacle 126-1 to 126-3 (collectively "cable receptacles 126," and generically "cable receptacle 126"). In one implementation, adapter 124 may be formed of an insulative material, such as rubber, a thermoplastic, or epoxy.

As shown in FIG. 1, each tap 108 includes a cable receptacle interface 127 that includes a substantially cylindrical flange or cuff portion configured to frictionally engage cable receptacle 126. For example, an inside diameter of a forward end of cable receptacle 126 may be sized to frictionally engage the cuff portion of interface 127. Each cable receptacle 126 may be substantially cylindrical and may be configured to surround and protect an interface between power cable assembly 104 and bus extensions 110. In one implementation, for example, cable receptacle 126 may provide a weather-resistant barrier for the interface between power cable assembly 104 and bus extensions 110.

Yoke 102 may include a semi-conductive outer shield 128 formed from, for example, a peroxide-cured synthetic rubber, commonly referred to as EPDM (ethylene-propylene-dien-emonomer). Within shield 128, yoke 102 may include an insulative inner housing 130, typically molded from an insulative rubber or epoxy material. Central conductor 106 may be enclosed within insulative inner housing 130.

Regarding cable receptacles 126, each cable receptacle 126 may include an EPDM outer shield 132 and an insulative inner housing 133, typically molded from an insulative rubber or epoxy material. Cable receptacle 126 may further include a conductive or semi-conductive insert 134 having a longitudinal bore therethrough. Upon assembly, cable receptacle 126 surrounds the interface between power cable assembly 104 and bus extension 110. In one implementation, forward ends of insert 134 and outer shield 132 may be configured to frictionally engage a portion of yoke inner housing 130 at each tap 108 upon assembly of splicing connector 100, thereby ensuring the electrical integrity of splicing connector 100.

In some instances, momentary high current surges in a high voltage environment may initiate bending forces in power cable assembly 104. These bending forces may overcome the frictional engagement between the yoke inner housing 130 at tap 108 which could result in a compromise of the weather-resistant barrier. In other instances, air expansion within the area inside cable receptacle 126 may provide a similar effect. Thus, consistent with implementations described herein, tubular extensions 140-1 to 140-3 (collectively "tubular extensions 140," and generically "tubular extension 140") may extend from a respective bus extension 110-1 to 110-3.

As shown in FIG. 1, tubular extension 140 may be configured to fit within the inside diameter of insert 134 of cable receptacle 126 and over yoke spade portion 112 and crimp connector 116 without interference. Thus, tubular extension 140 may have different wall thickness depending on the particular size and available clearances at the interface of crimp connector 116 and insert 134. Tubular extension 140 may include a metallic material, such as aluminum, or a plastic material, such as reinforced fiberglass. In one implementation, tubular extension 140 may be made from the same material as central conductor 106. Tubular extension 140 may generally include a cylindrical shape or another tube-like cross-section (e.g., octagonal, hexagonal, etc.) to match the shape of bus extension 110. Tubular extension 140 may be secured to bus extension 110 by welding, by a threaded connection, or by another type of connection.

When yoke 102 and power cable assembly 104 are fully connected (e.g., crimp connector spade portion 120 and yoke spade portion 112 are secured together and cable receptacle 126 is slid fully forward), tubular extension 140 supports cable receptacle 126 to prevent misalignment of power cable assembly 104 with yoke 102 and/or to prevent movement of power cable assembly 104 (e.g., rotation or bending relative to yoke 102) due to temporary high current.

Figure 2:
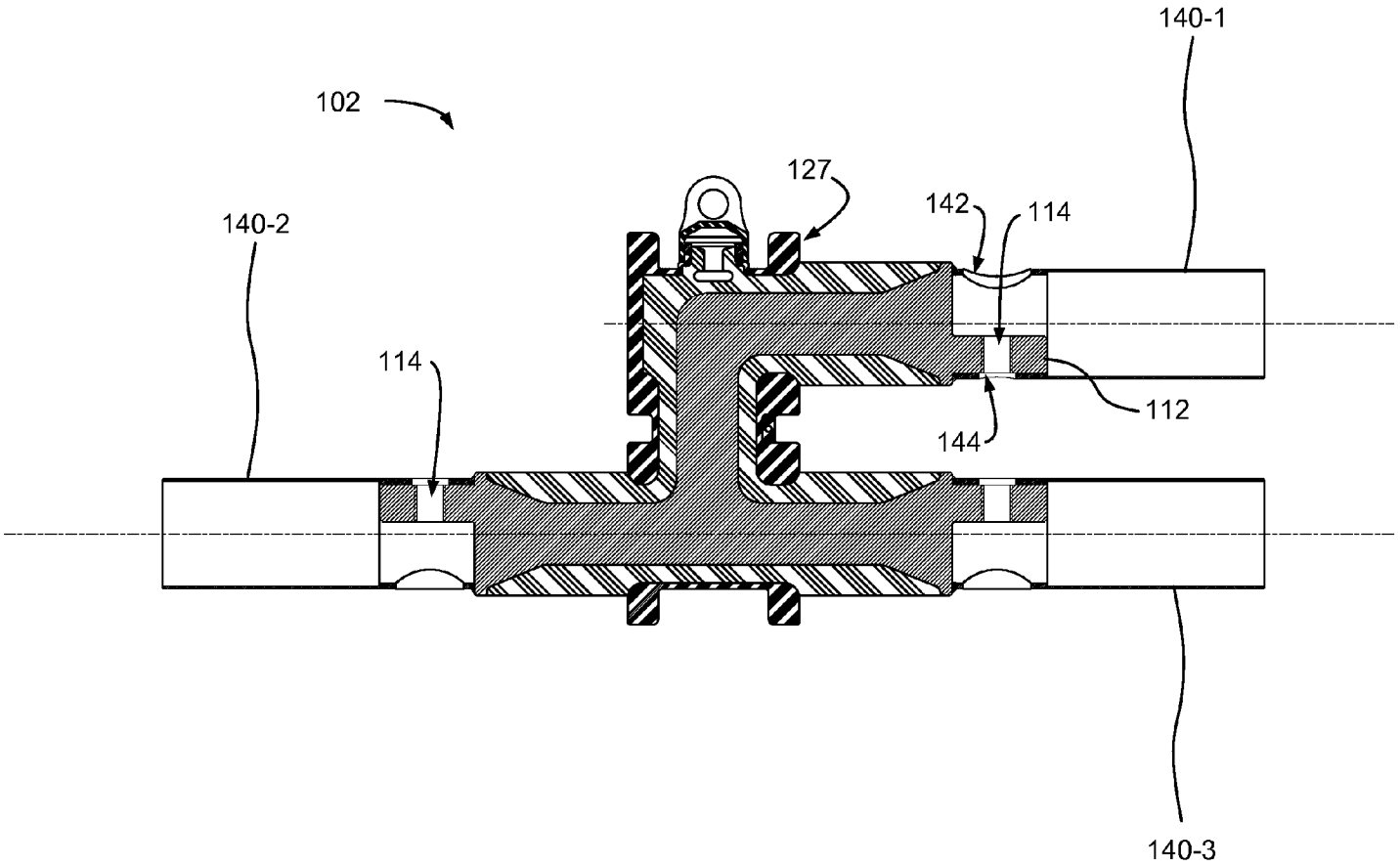
FIG. 2 is a schematic cross-sectional diagram illustrating a three-way yoke of FIG. 1 consistent with implementations described herein.
Figure 3:
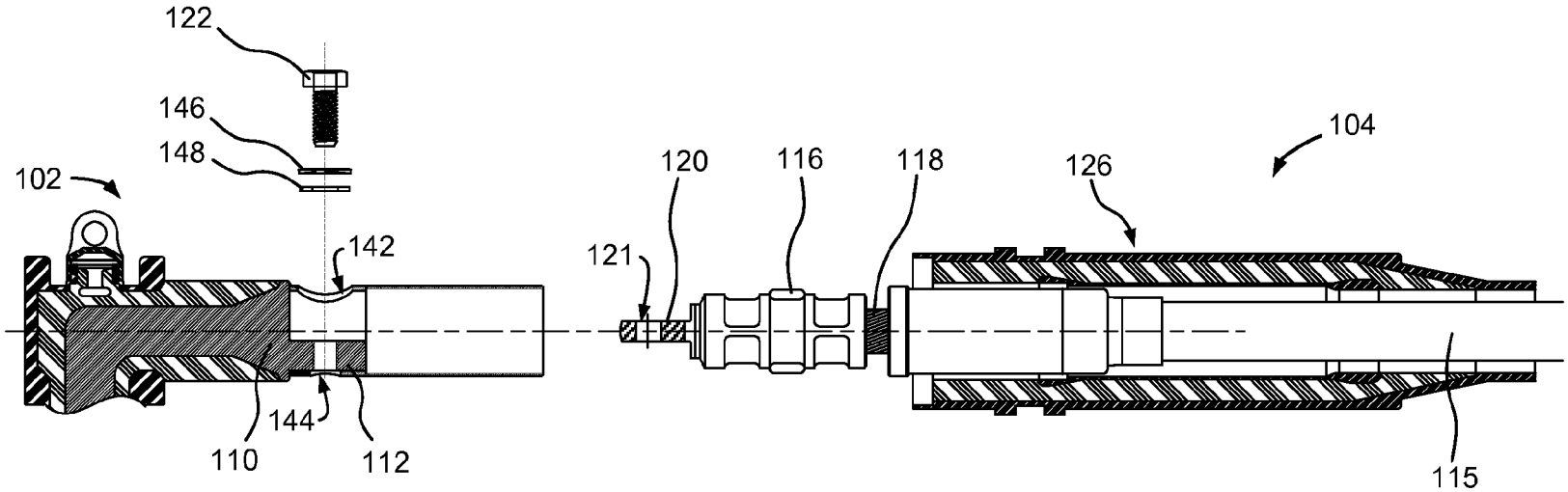
FIG. 3 is an exploded, schematic, partial cross-sectional diagram illustrating a portion of the three-way yoke and one of the cable assemblies of FIG. 1.

FIG. 2 is a schematic cross-sectional diagram illustrating three-way yoke 102. FIG. 3 is an exploded, schematic, partial cross-sectional diagram illustrating a portion of the three-way yoke 102 and one of the power cable assemblies 104. Referring collectively to FIGS. 2 and 3, tubular extension 140 may include an access hole 142 and an exit hole 144. Tubular extension 140 may be affixed to bus extension 110 so that access hole 142 and exit hole 144 may align with bore 114 (e.g., to permit insertion of threaded fastener 120 into bore 114). Access hole 142 may be sized to permit fastener 122, a disc spring 146, and a washer 148 to pass through with sufficient clearance to enable assembly of threaded fastener 122 through forward spade portion 120 and yoke spade portion 112. More particularly, when assembled, access hole 142, exit hole 144, and bore 114 may align with opening 121 to permit threaded fastener 122 to be inserted and engage corresponding threads in bore 114. Exit hole 144 may be provided to clear threaded fastener 122 after assembly (e.g., to allow fastener 122 to extend past the end of bore 114).

Figure 4A:
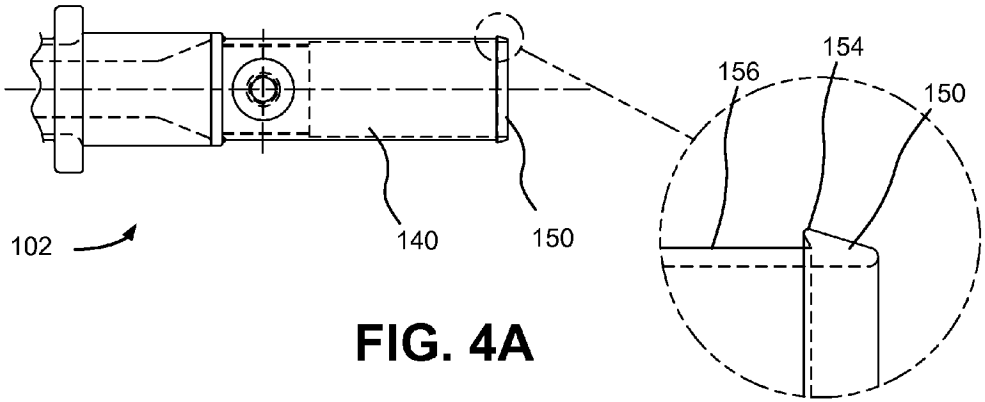
FIG. 4A-4C are top views of a portion of the three-way yoke of FIG. 1 according to different implementation described herein.
Figure 4B:
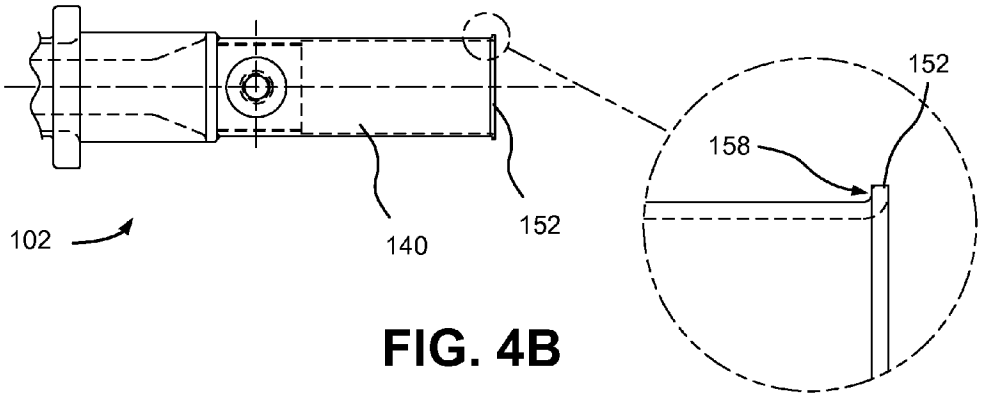
Figure 4C:
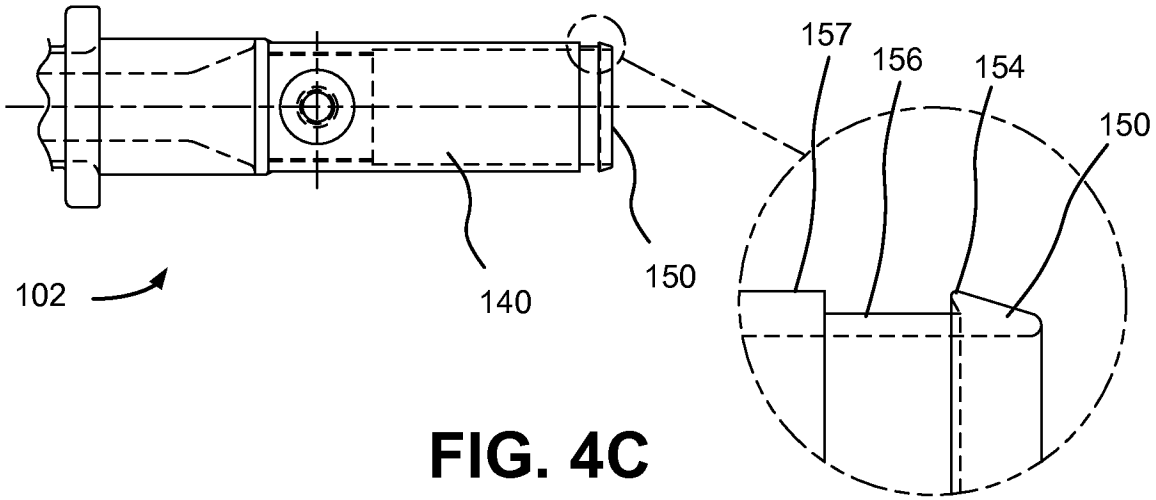

FIGS. 4A, 4B, and 4C are top views of a portion of the three-way yoke 102 according to different implementation described herein. FIGS. 4A and 4C illustrate a hook-shaped retention ring 150 on a distal end of tubular extension 140, while FIG. 4B illustrates a flared retention ring 152 on the distal end of tubular extension 140. As described further herein, hook-shaped retention ring 150 or flared retention ring 152 may be used in a latching arrangement with receptacle 126 to restrain outer shield 132 of receptacle 126 from sliding back from shield 128 of yoke 102.

Referring to FIG. 4A, hook-shaped retention ring 150 may be formed, for example, by machining away a portion of an outer surface of tubular extension 140 such that a ring-shaped lip 154 extends beyond the machined surface 156. Referring to FIG. 4B, flared retention ring 152 maybe formed, for example, by turning out the circumference of the distal end of tubular extension 140. Thus, retention ring 152 may form an interference surface 158 that may be used, for example, in a latching arrangement described further herein. Referring to FIG. 4C, hook-shaped retention ring 150 may be formed by machining away a smaller portion (relative to that of FIG. 4A) of the outer surface of tubular extension 140 such that a ring-shaped lip 154 extends beyond the machined surface 156 and a larger diameter outer surface 157 extends to the proximal end of tubular extension 140.

Figure 5:
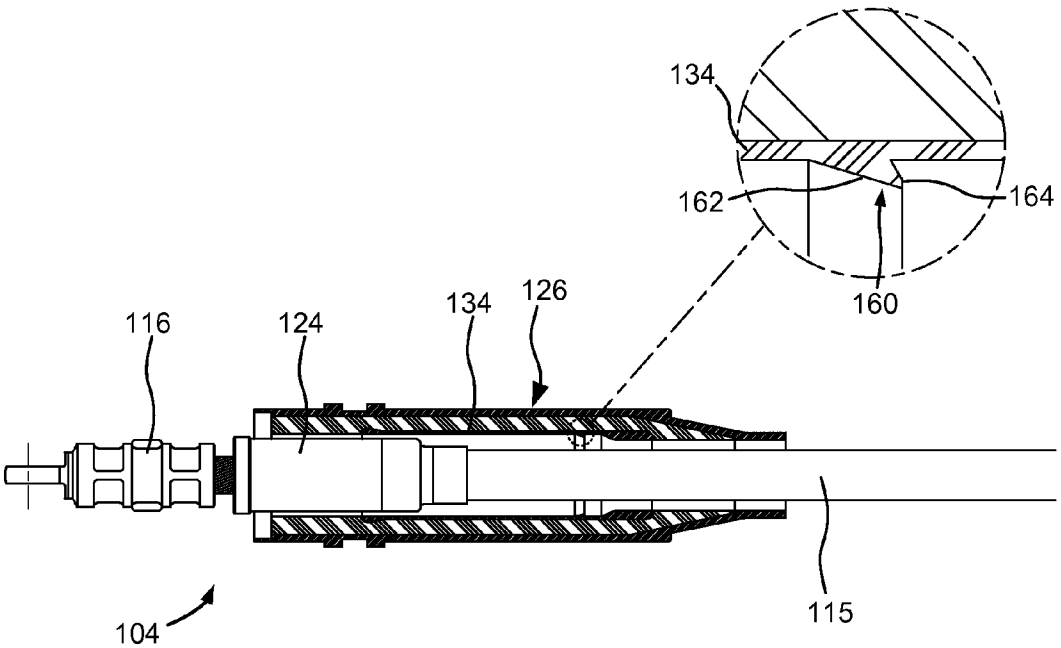
FIG. 5 is a schematic cross-sectional diagram illustrating a cable assembly according to another implementation described herein.

FIG. 5 is a schematic cross-sectional diagram illustrating power cable assembly 104 according to another implementation described herein. In the configuration of FIG. 5, cable receptacle 126 is slid back from crimp connector 116 (e.g., prior to connection of power cable assembly 104 and bus extension 110). As shown in FIG. 5, insert 134 of cable receptacle 126 may include a latching ring 160. Latching ring 160 may extend radially along the inner circumference of insert 134. In one implementation, latching ring 160 may be an integrally molded piece with insert 134. In another implementation, latching ring 160 may be affixed to, or otherwise formed on, an inner surface of insert 134. Latching ring 160 may include a forward sloped surface 162 and a rear engagement surface 164.

Figure 6A:
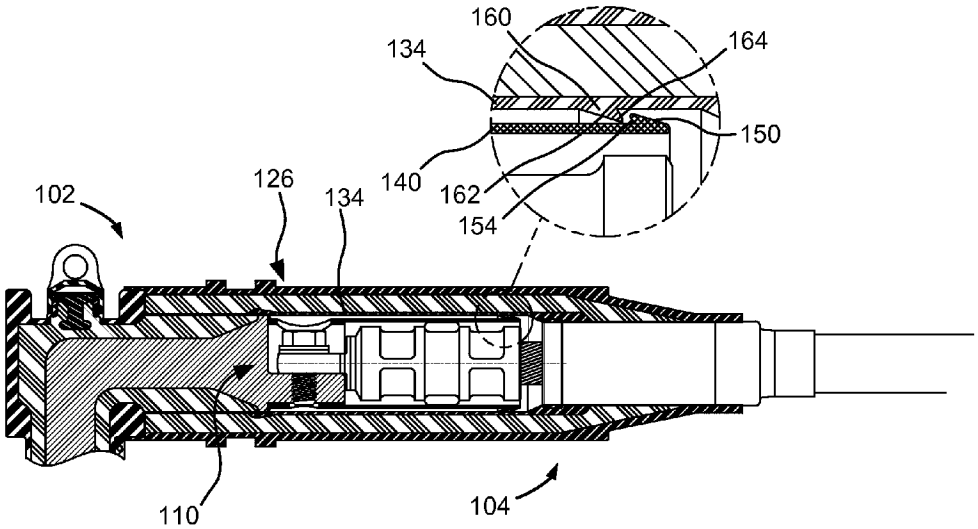
FIGS. 6A-6C are schematic, cross-sectional diagrams illustrating the interface between the receptacle insert of FIG. 5 and the tubular extension of FIGS. 4A-4C.
Figure 6C:
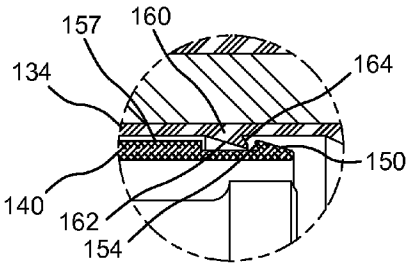
Figure 6B:
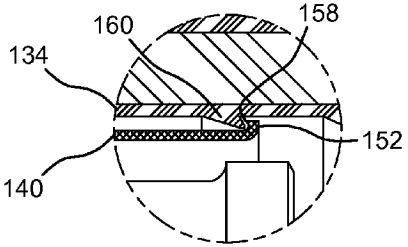

FIGS. 6A, 6B, and 6C are schematic, cross-sectional diagrams illustrating the interface between receptacle insert 134 with latching ring 160 and tubular extension 140. In each of FIGS. 6A-6C, cable receptacle 126 is slid over crimp connector 116 and tubular extension 140 (e.g., after connection of power cable assembly 104 and bus extension 110). FIGS. 6A and 6C show the interface between retention ring 150 and latching ring 160, while FIG. 6B shows the interface between retention ring 152 and latching ring 160. Generally, latching ring 160 may be positioned along cable receptacle 126/insert 134 to engage retention ring 150 or retention ring 152 when cable receptacle 126 is fully closed over crimp connector 116. Retention rings 150 or 152 and latching ring 160 may be generally configured to interlock to retain cable receptacle 126 in a position to maintain a weather-resistant barrier for the interface between power cable assembly 104 and bus extension 110.

Latching ring 160, insert 134, and/or cable receptacle 126 may have elastic properties to both allow for sealing of the interface between power cable assembly 104 and yoke 102 and to permit latching ring 160 to be forced over retention ring 150 and/or retention ring 152. Referring to FIG. 6A, as cable receptacle 126 is slid over tubular extension 140 (e.g., toward yoke 102), latching ring 160 may slide over retention ring 150. Forward sloped surface 162 may act as an inclined plane to translate axial forces applied to cable receptacle 126 and force latching ring over retention ring 150. In one implementation, retention ring 150 may include a corresponding slope to guide forward sloped surface 162 over retention ring 150. When cable receptacle 126 is fully inserted over tubular extension 140, latching ring 160 will pass over retention ring 150 so that rear engagement surface 164 will contact lip 154 if cable receptacle 126 is forced away from yoke 102.

Referring to FIG. 6B, as cable receptacle 126 is slid over tubular extension 140 (e.g., toward yoke 102), latching ring 160 may slide over retention ring 152. Forward sloped surface 162 may act as an inclined plane to translate axial forces applied to cable receptacle 126 and force latching ring over retention ring 152. When cable receptacle 126 is fully inserted over tubular extension 140, latching ring 160 will pass over retention ring 152 so that rear engagement surface 164 will contact interference surface 158 if cable receptacle 126 is forced away from yoke 102.

Referring to FIG. 6C, cable receptacle 126 is slid over tubular extension 140 (e.g., toward yoke 102) and latching ring 160 may slide over retention ring 150 similar to that described above with respect to FIG. 6A. Eventually, latching ring 160 will pass over retention ring 150 so that rear engagement surface 164 will contact lip 154 if cable receptacle 126 is forced away from yoke 102. However, relative to the configuration of FIG. 6A, the larger diameter outer surface 157 may provide a smaller clearance between tubular extension 140 and insert 134 of receptacle 126.

Referring again collectively to FIGS. 6A-6C, the interface of retention ring 150 and/or retention ring 152 and latching yoke 160 (e.g., when cable receptacle 126 is slid fully onto tubular extension 140), may removeably lock cable receptacle 126 in place. Elastic properties of latching ring 160, insert 134, and/or cable receptacle 126 may permit removal of cable receptacle 126 from tubular extension 140 using, for example, a removal tool.

In implementations described herein a yoke for a power cable connector may include a spade assembly that includes a bore therethrough and an electrical interface for a receptacle of a power cable. A tube-like structure may be affixed to the yoke and configured to encircle at least a portion of the spade assembly. The tube-like structure may include an entry hole through the tube-like structure to permit insertion of a fastener transversely through the tube-like structure and through the bore to securing the spade assembly to a portion of a second electrical component, such as a spade assembly of a power cable. The tube-like structure may have an outside diameter configured to engage an inside diameter of the receptacle and support the receptacle when the receptacle is connected to the electrical interface.

The above-described power cable yoke with tubular extension provides an effective and repeatable means for preventing misalignment and/or relative movement of a yoke and an installed power cable assembly. Misalignment and/or movement may occur, for example, from bending forces caused by a high current momentary surge. This misalignment and/or movement may compromise the weather-resistant barrier provided by the cable receptacle. For example, water may reach the interface between cable receptacle and the taps of the yoke and eventually cause the connecting parts to electrically fail.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments. For example, implementations described herein may also be used in conjunction with other devices, such as high voltage switchgear equipment, including 15 kV, 25 kV, or 35 kV equipment.

For example, various features have been mainly described above with respect to electrical connectors, and splicing or yoke-type connectors in particular. In other implementations, other medium/high voltage power components may be configured to include the connection mechanism configurations described above.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above-mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. A connector, comprising:
a first member having a first bore therethrough;
a second member having a second bore therethrough configured to align with the first bore in the first member;
a fastener for securing the first member to the second member through the first bore and the second bore; and
a tubular extension affixed at a proximal end to the first member and configured to encircle at least a portion of the first member and a portion of the second member, wherein the tubular extension comprises:
an access hole to permit insertion of the fastener through the first bore and the second bore,
an exit hole to permit extension of the fastener through the first bore or the second bore; and
a receptacle configured to slide over at least a portion of the first member, a portion of the second member, and the tubular extension to form a weather-resistant barrier for the connector, and wherein the tubular extension is configured to support the receptacle.

2. The connector of claim 1, wherein the tubular extension includes a distal end with an opening to receive the portion of the second member.

3. The connector of claim 2, wherein the tubular extension includes an inside diameter configured to receive the portion of the second member without interference.

4. The connector of claim 1, wherein the tubular extension is rigidly fastened to another portion of the first member.

5. The connector of claim 4, wherein the tubular extension is welded to the other portion of the first member.

6. The connector of claim 4, wherein the tubular extension and the other portion of the first member are connected via a threaded connection.

7. The connector of claim 1,
wherein the tubular extension further comprises a retention ring on an outside diameter of the tubular extension,
wherein the receptacle further comprises a latching ring on an inside diameter of the receptacle, and
wherein the retention ring and the latching ring are configured to interlock to retain the receptacle in position to maintain the weather-resistant barrier.

8. The connector of claim 7, wherein the retention ring is formed from a turned out portion at the distal end of the tubular extension.

9. The connector of claim 7, wherein the retention ring is formed by machining an outside diameter of the tubular extension.

10. The connector of claim 1, wherein the tubular extension includes an aluminum material.

11. The connector of claim 1,
wherein the first member is a first electrical device and second member is a second electrical device, and wherein the tubular member is configured to prevents bending of the second member, relative to the first member, during a high current surge.

12. The connector of claim 11, wherein the first member comprises a first spade portion of a high voltage power cable yoke and the second member comprises a second spade portion of a high voltage power cable.

13. An electrical connector, comprising:

a spade portion including a bore therethrough;

an electrical interface for a receptacle of a power cable;

a tube-like structure affixed at a proximal end to the electrical connector and configured to encircle at least a portion of the spade portion, wherein the tube-like structure includes:

an access hole through a wall of the tube-like structure to permit insertion of a fastener through the bore for securing the spade portion to a portion of a second electrical component, and an outside diameter configured to engage an inside diameter of the receptacle and support the receptacle when the receptacle is connected to the electrical interface.

14. The electrical connector of claim 13, wherein the tube-like structure further comprises:

a retention ring, on an outside diameter of the tubular extension, configured to engage a corresponding latching ring on an inside diameter of the receptacle.

15. The electrical connector of claim 14, wherein the retention ring is formed by machining an outside diameter of the wall of tubular extension.

16. The electrical connector of claim 14, wherein the retention ring is formed from a turned out portion of the wall at a distal end of the tubular extension.

17. The electrical connector of claim 13, wherein the tube-like structure further comprises:

an inside diameter configured to receive the portion of a second electrical component without interference.

18. The electrical connector of claim 13, wherein the tube-like structure further comprises:

an exit hole, opposite the access hole, to permit extension of the fastener through the bore.

19. A method for connecting a first electrical component to a second electrical component, comprising:

providing a first member having a first spade portion with a first bore therethrough and a tube-like structure encircling the first spade portion;

providing a second member having a second spade portion with a second bore therethrough and a receptacle slidably connected to the second member;

positioning the second spade portion within the tube-like structure and aligning the second bore with the first bore in the first member;

inserting a fastener through an access hole in the tube-like structure into the first bore and the second bore; and sliding the receptacle over the tube-like structure to provide a weather-resistant barrier over the tube-like structure.

20. The method of claim 19, wherein sliding the receptacle over the tube-like structure further comprises sliding a latching ring on an inside diameter of the receptacle over a retention ring on an outside diameter of the tube-like structure.

* * * * *

UNITED STATES PATENT AND TRADEMARK OFFICE

CERTIFICATE OF CORRECTION

PATENT NO. : 8,986,034 B2
APPLICATION NO. : 13/903049
DATED : March 24, 2015
INVENTOR(S) : Larry N. Siebens It is certified that error appears in the above-identified patent and that said Letters Patent is hereby corrected as shown below:

In the claims

In claim 11, at column 7, line 1, change the phrase: "wherein the tubular member is configured to prevents" to "wherein the tubular member is configured to prevent"

Signed and Sealed this
First Day of December, 2015

Michelle K. Lee

Michelle K. Lee
*Director of the United States Patent and Trademark Office*